US008453362B2

(12) United States Patent
Cappelle et al.

(10) Patent No.: US 8,453,362 B2
(45) Date of Patent: Jun. 4, 2013

(54) SNAP N' STRETCH STRETCHER BAR WITH CONNECTING SEGMENTS

(76) Inventors: Claudia Marie Cappelle, Woodbridge, VA (US); Richard David Karasiewski, Elkridge, MD (US)

( * ) Notice: Subject to any disclaimer, the term of this patent is extended or adjusted under 35 U.S.C. 154(b) by 61 days.

(21) Appl. No.: 13/167,494

(22) Filed: Jun. 23, 2011

(65) Prior Publication Data

US 2012/0324770 A1 Dec. 27, 2012

(51) Int. Cl.
*D06C 3/08* (2006.01)
*D06C 3/00* (2006.01)

(52) U.S. Cl.
USPC ..... 38/102.5

(58) Field of Classification Search
USPC ..... 38/102, 102.91; 160/377, 378, 398, 160/404
See application file for complete search history.

(56) References Cited

U.S. PATENT DOCUMENTS

| | | | | | |
|---|---|---|---|---|---|
| 3,482,343 | A * | 12/1969 | Hamu | 38/102.5 |
| 3,830,278 | A * | 8/1974 | Packer | 160/378 |
| 4,144,660 | A * | 3/1979 | Lamb | 38/102.5 |
| 4,179,830 | A * | 12/1979 | Lamb | 38/102.5 |
| 5,493,800 | A * | 2/1996 | Chinitz | 38/102.4 |
| 6,269,569 | B1 * | 8/2001 | Doone | 40/603 |

* cited by examiner

*Primary Examiner* — Ismael Izaguirre

(57) ABSTRACT

Disclosed is a-stretcher bar frame and canvas fastening system. The system consists of side bars of variable lengths, pre-molded corners, and connecting segments for easy assembly and disassembly. The interlocking bar, corner, and connecting segments, features a locking mechanism utilizing the male plug and a female socket. The connecting segment plug-includes four resilient flexible arms with flat tooth surfaces that interlock during insertion into the bar or corner socket. The plug and socket members snap together for a tight and straight fit that is released using a side release mechanism. The side release mechanism disengages the stretcher bar segments by pressing inward on the flat tooth surfaces of the latching arms of the connecting segments. The back side of the stretcher bar features a self-healing canvas fastening block for insertion of staples and other fasteners allowing the canvas to be stretched or removed.

16 Claims, 9 Drawing Sheets

SNAP N' STRETCH STRETCHER BAR WITH CONNECTING SEGMENTS

BACKGROUND OF THE INVENTION

1. Field of the Invention

The present invention relates to the field of stretcher bar frames (stretcher bars) and canvas fastening for artwork. More particularly, this invention is a unique and improved stretcher bar system using interchangeable side bar, corner, and connecting segments allowing for lengthening or shortening of the sides of the stretcher bars. It features a snap fit, interlocking, mechanism for easy assembly or disassembly of the stretcher bars. The canvas fastener system also provides for easy mounting, re-stretching, removal, and remounting of canvas.

2. The Prior Art

In the field of art, canvas paintings are traditionally mounted to a permanent wooden frame comprised of wooden sections referred to as stretcher bars that provide a taunt support for the stretched canvas. The stretcher bar wooden sections are assembled by means of interlocking dove-tail edges wedged together to form corners. Wooden tightening wedges are used to adjust corners to produce a perfect square. Cross braces are sometimes used as a stabilizing tension brace. Canvas or other material is stretched around and over the front perimeter of the stretcher bars and affixed to the back side by conventional means using staples or nails.

In general, current commercially known wooden stretcher bars are made in fixed sizes and frames and cannot to be customized in length and width. Several other limitations of wooden stretcher bars include warping, difficulty in forming exact corners, and the affordability of museum depth stretcher bars. A limited number of adjustable frames that expand or contract in some manner are known. These adjustable frames have various limitations and are difficult to use. U.S. Pat. No. 4,519,151 discloses a hollow tubular metallic frame coupled together at the end by a co-acting pair of corner elements. The frame size can be selectively expanded and contracted by inserting one of five fixed lengths of tubular frame side elements. Major disadvantages of this design is its limited non-combinable fixed length dimensional sides and round tubular sides that are not generally used in the field of art or acceptable by galleries. U.S. Pat. No. 4,144,660 discloses an adjustable canvas stretching frame of separate, interchangeable, uniform frame segments, which can be interconnected to form a limited number of small rectangular or square frames. The primary feature of this device is to provide a means to maintain an overall rectangular shape of the frame, adjust gaps between adjacent segments of the frame, and to provide a taut surface by adjusting the tension within individual frame segments, so a canvas can be re-stretched without damaging the canvas and/or removing the canvas from the frame. Several shortcomings to this mechanically complex design include its numerous parts and special hardware required for its assembly. Additionally, it does not allow for a canvas to be easily removed and reused. U.S. Pat. No. 6,253,471 discloses an adjustable canvas stretching frame with fixed corners and non-connectable, fixed wooded sides, which require cutting to a desired length and width. Several labor intensive shortcomings to this design include advance knowledge of woodworking technique, tools to cut wood to exact length and width for the sides, a drill to cut circular apertures, a router for notches, and metal screws to secure the frame. When a different side length or width is desired, additional wood and woodworking skills are required. U.S. Pat. No. 6,895,701 discloses an adjustable metal strainer frame for mounting art canvas eliminating conventional welding and hardware item such as rivets, nuts, and bolts. Major shortcomings to this design include having to cut metal sides to fixed lengths when a different side length or width is desired, the inability to connect side members to form longer or shorter side lengths, and the need to use bracing and hardware to form square and secure corners. U.S. Pat. No. 6,675,510 discloses a lateral and longitudinal mechanized edge gripping method to avoid uneven stresses, distortion, corner wrinkles, and tearing of canvas. It primarily allows for removal and remounting of the canvas but the disadvantage is that its difficulty to evenly stretch canvas due to interference from and canvas grippers. Additional and various other prior art is also cited in U.S. Pat. Nos. 4,144,660, 4,519,151, and 6,675,510, and is incorporated herein by reference.

The above framing and stretching canvas references are primarily for attaching or remounting of canvas and do not allow for modifications in the overall size of the stretcher bar frame. The prior art is not designed to easily adjust for any expansion, contraction or distortions of the canvas due to changes in environmental conditions, nor do they provide the capability or means, without prior training, skill, experience, or strength, to quickly and easily assemble/disassemble, lengthening/shortening the stretcher bar frame to other frame configurations. The prior art does not allow the stretcher bars to be easily dismantled for compact storage and for less costly transport. It also does not address the need for affordable museum quality stretcher bars.

SUMMARY OF THE INVENTION

The primary object of the present invention is to provide an affordable, easily reconfigurable, stretcher bar frame and canvas fastening system that quickly and easily snaps together using a combination of interconnecting and interchangeable side bar, corner, and connecting segments.

It is a further object of this invention to provide a stretcher bar framing system where the side lengths and widths of the stretch bar frame can be lengthened or shortened by adding or subtracting an even number of side bar segments to the stretcher bar frame to form an array of customized stretcher bar frame sizes using a combination of incremental length side bar segments.

It is a further object of this invention to provide a novel and unique single stretcher bar frame system having a multiplicity of configurable stretcher bar frame sizes eliminating the expense of having a large number of various sizes of costly stretcher bar frames.

It is a further object of this invention to provide a system of pre-molded, fixed ninety degree corner segments allowing for exact square corners without the need for wedges, corner bracing, or tension bars.

It is a further object of this invention to provide a system where the side bar and corner segments easily match, snap together, and interlock by means of an interlocking mechanism consisting of side bar and corner segments having female socket members at each longitudinal end and connecting segments having a dual pair of opposite and opposing male plug members having flexible flat headed latching arms.

It is a further object of this invention to provide a system where a side-release mechanism is formed at each longitudinal end of the socket open middle cavity at the outside and inside apertures, once a connecting segment male plug member is fully inserted into either a side bar and corner segment's female socket member.

It is a further object of this invention to provide a system that can be quickly and easily disassembled, reconfigured, or stored by separating the side bar, corner, and connecting segments by concurrently pressing on the connecting segment's flexible flat tooth surface sides to release the stretcher bar frame segments.

It is a further object of this invention to provide a system where the interior end side of each side bar and corner segment has an upper and lower rectangular guide bar opening that matches and mates with the dual pair of connecting segment upper and lower rectangular guide bars, and an extended outer edge joining lip along the circumference of each open socket side end, to secure the stretcher bar frame's side bar and corner segments to the connecting segments for a strong, even and straight alignment.

It is another object of this invention is to provide an easy means to fasten a canvas to a self-healing fastening block, consisting of flexible polyurethane, a resilient polyolefin, or a similar functional type material (such as wood or compressed cardboard) on the back side of the stretcher bar frame, allowing staples, tacks, or other gripping fasteners to secure a canvas to the frame, and allowing a canvas to be removed, mounted/re-mounted stretched/re-stretched, repeatedly on the reconfigurable stretcher bar frame without damaging the frame or canvas.

It is still a further object of this invention to provide a system with side bar, corner, and connecting segments that are preferably made of a low cost, light-weight, non-warping, durable plastic, resin, or any suitable material known in the art for molding or machining that provides structural durability, resiliency, and stability.

Finally, it is a goal of this invention to provide a stretcher bar frame and canvas fastening system of a museum quality dimensional profile depth that does not require the need for additional framing of the art work.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF PREFERRED EMBODIMENT OF THE INVENTION

Figure 1:
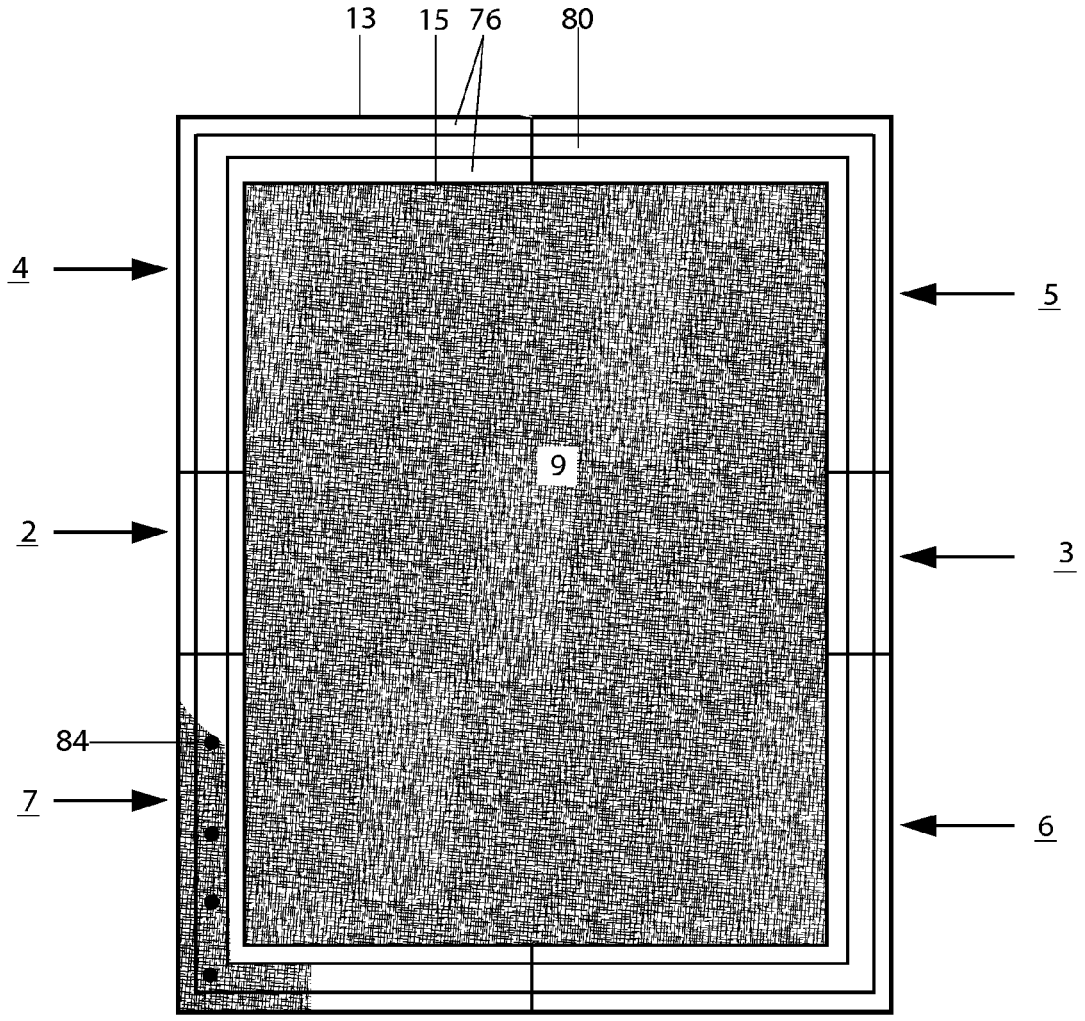
FIG. 1 is a back view of the first embodiment of the stretcher bar frame and canvas fastening system assembled in accordance with the present invention; illustrating side bar segments, corner segments, and a partially attached canvas.

The present invention relates to a novel and unique stretcher bar frame and canvas fastening system that comprises of a plurality of interchangeable, interconnecting, snap fitting, side bar, corner, and connecting segments. With reference to the drawings, and initially to FIG. 1, it can be seen how the stretcher bar frame and canvas fastening system allows for the assembly of a broad array of square and rectangular shaped stretcher bar frames 1. This is accomplished by adding or removing various length side bar segments 2, along the periphery within the four corner segments 4, to lengthen or shorten the length and width of the sides of the stretcher bar frame 1. As noted above, FIG. 1 is a view that depicts an assembled stretcher bar frame 1, in one of many achievable configurations. It consist of two side bar segments 2 and 3, four corner segments 4, 5, 6, and 7, and six internal connecting segments 8. The depicted stretcher bar frame 1, is assembled by inserting and snapping together a connecting segment 8 to side bar segment 2 and corner segment 4, a connecting segment 8 to corner segments 4 and 5, a connecting segment 8 to corner segment 5 and side bar segment 3, a connecting segment 8 to side bar segment 3 and corner segment 6, a connecting segment 8 to corner segments 6 and 7, and a connecting segment 8 to side bar segment 2 corner segment 7.

Upon assembling the two side bars segments 2 and 3, the four corner segments 4, 5, 6, and 7, and the six internal connecting segments 8, stretcher bar frame 1 is formed. FIG. 1 also illustrates how a canvas 9 is stretched over the front side surface 75 of the stretcher bar frame 1, upon and around the elevated outside front canvas perimeter surfaces 73, along and against the outside side perimeter wall 13, and partially around the back side surface perimeter edges 76 of the stretcher bar frame 1, to the back side fastening block 80. FIG. 1 also depicts how a canvas 9 is fastened to corner segment 7 using four fasteners 84. The process of fastening the canvas 9 to all associated side bars 2 and corner 4 segments continue, in this describe manner, until the front side surface 75 of the canvas 9 is taut, flat, and secured to the back side fastening block 80.

Figure 2:
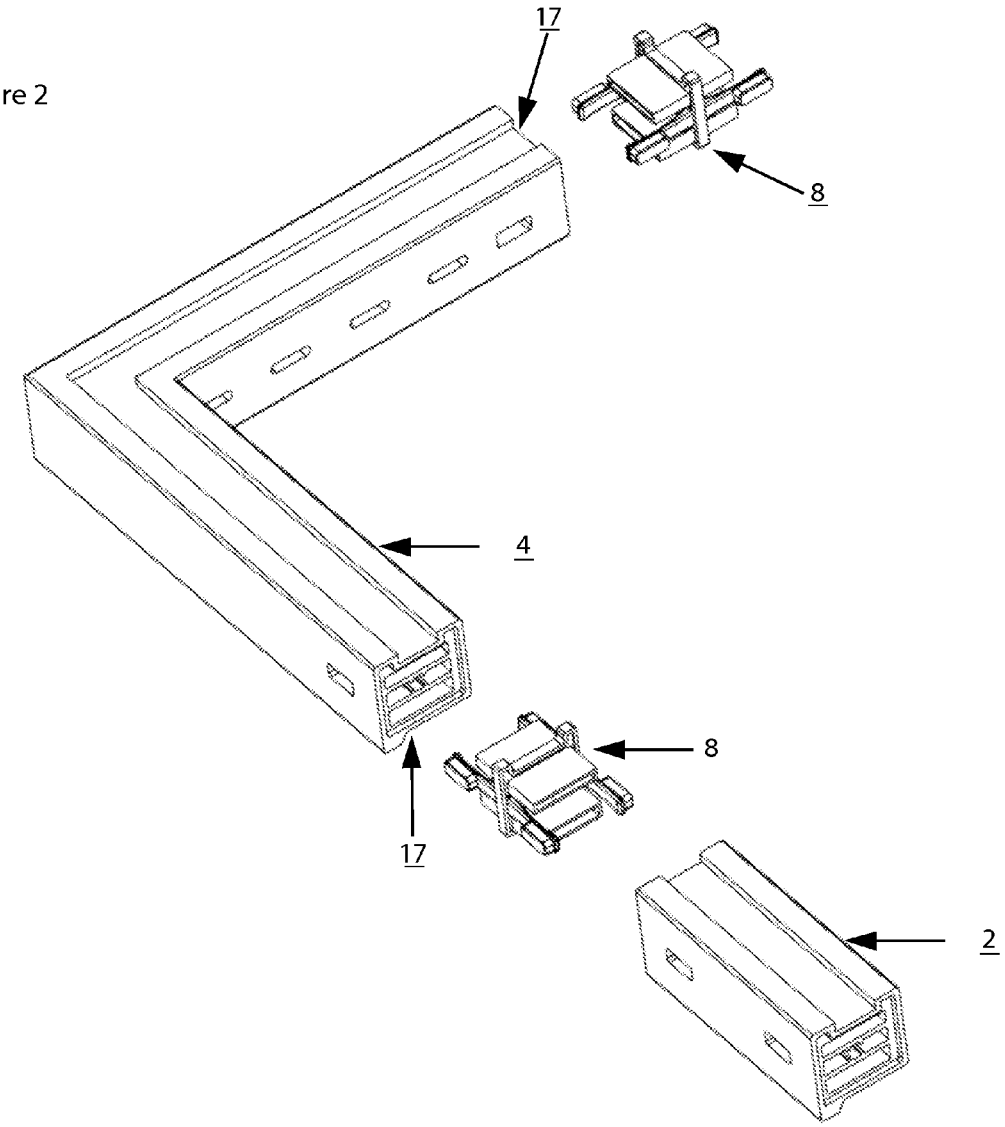
FIG. 2 is a partial three-dimensional perspective back side view; illustrating the means to connect adjacent stretcher bar frame side bars, corner, and connecting segments in FIG. 1.

FIG. 2 is a three-dimensional perspective back side surface view 76, illustrating the snap fit structural alignment means to snap together multiple adjacent side bar 2, corner 4, and connecting 8 segments in FIG. 1, assembly of one of various arrays of configurable stretcher bar frame 1, and depicting how a side bar segment 2 is joined to connecting segment 8, to corner segment 4, to connecting segment 8, to a connecting segment 8. This same snapping together and locking mechanism of stretcher bar frame segments continues and is utilized to join additional side bars 2, corners 4, and connecting 8 segments, until the desire stretcher bar frame 1 size is constructed. Each side bar 2 or corner 4 segment can be snapped and interlocked together to another side bar 2 or corner 4 segment by inserting a connecting segment 8 male plug member ends (plug) 10 into a bar 2 or corner 4 segment's female socket member end (socket) 11.

The outside length of each corner segment 4, depicted in FIG. 1, is 12 inches on each outside surface wall 13. The outside length of the side bar 2 segments depicted in FIG. 1 is 6 inches in length. The most common lengths of side bar 2 segments are 6 inches and 12 inches. Side bars 2 are always added or removed in pairs for consistency when assembling a stretcher bar frame 1.

Side bar 2 and corner 4 segments can be combined to assemble side lengths and widths ranging from 24 inches to 96 inches, and various common size stretcher bar side lengths in between. For illustrative purposes only, the number and lengths of the side bar 2 and corner 4 segments required to assemble a range of stretcher bar frame 1 side lengths from 24 inches to 96 inches is listed in the below.

| Bars Required for Specific Side Lengths | |
|---|---|
| 2-12" corners | 24" |
| 2-12" corners plus 1-6" side bar | 30" |
| 2-12" corners plus 1-12" side bar | 36" |
| 2-12" corners plus 2-12" side bars | 48" |
| 2-12" corners plus 3-12" side bars | 60" |
| 2-12" corners plus 4-12" side bars | 72" |
| 2-12" corners plus 5-12" side bars | 84" |
| 2-12" corners plus 6-12" side bars | 96" |

The overall dimensional length and width of the stretcher bar frame 1 is not limited to 96 inches. Larger stretcher bar frames can be assembled by adding additional 6 and 12 inch side bar segments. Furthermore, with the addition and combination of 1, 2 and 4 inch side bar segments, all one inch incremental lengths and width between 24 inches to 96 inches can be assembled. The length of side bar 2 and corner 4 segments are not limited to inches and can be in other measurement units (e.g., metric).

FIG. 2 illustrates the structural means to guide and align side bar 2 and corner 4 segments into connecting segments 8. As depicted in FIG. 2, the connecting segment's plugs 10 are inserted into the middle open cavities 20 of either a side bar 2 or corner 4 segment's sockets 11. The connecting segment's 8 two opposite upper rectangular guide bars 65, and two opposite lower rectangular guide bars 69, extends distally along the upper and lower longitudinal axis from the sides 96 of the connecting segment plug base 32, towards the adjacent side ends 17 of either a side bar segment 2 and the corner segment 4, for added strength and to avoid twisting in the stretcher bar frame 1.

FIG. 2 also illustrates the interlocking mechanism to retain and interlock adjacent stretcher bar frame 1 side bar 2 and corner 4 segments to connecting segments 8. Each stretcher bar frame's 1 side bar 2 or corner 4 segments has a female socket member end 11, positioned at each opposite side end 17 of each side bar 2 or corner 4 segments. The aperture engagement surface 27 is designed and positioned to match with a flat tooth latching surface 26. When a plug 10 from a connecting segment 8 is inserted into the middle open cavity 20, of the socket 11, the plug and socket members mate and interlock by means of an aperture engagement surface 27 and a flat tooth latching surface 26, forming an interlocking connecting surface. The interlocking mechanism encompasses both aperture engagement surfaces 27, positioned at the outside side wall 13 and inside side wall 15, along with a mating flat tooth latching surface 26, positioned on each flexible flat headed latching arm 34, on each of the connecting segment's plug 10, thus securing the stretcher bar segments together.

FIGS. 3, 4, 5, 6, 7 and 8 are detail drawing of the side bar segment from different views. The side bar segment 2 has an upper front side surface 75, a back side surface 76, an outside side wall 13, an inside side wall 15, and two side end surfaces 17. The side bar segment also has an angular front side surface 74 between the upper front side surface 75 and the extended outside front canvas corner 73, a back side surface 76 with a trapezoid fastening channel 77, along the center longitudinal axis, having a fastening channel bottom wall 78 and two fastening channel side walls 79, allowing for the insertion of a permanent or removable seal-healing fastening block 80. The outside side wall 13 has an open outside aperture 12, near each side end 17, along the center longitudinal axis end, and an aperture engagement surface 27, adjacent to the aperture opening of each open outside apertures 12. The inside side wall 15 has an open inside aperture 14 near each side end 17, along the center longitudinal axis end, and an aperture engagement surface 27, adjacent to the aperture opening of each open inside apertures 14, and at least one cross brace entry/hanger wire port 16. The end side 17 of each side bar segment 2 has an open rectangular upper cavity 18, an open rectangular lower cavity 19, and an open rectangular middle cavity 20. The open middle cavity 20 encompasses the area between an internal top cavity wall 21, the opposing bottom cavity wall 22, and the pair of side cavity walls 23, each of which connects the top wall to the bottom wall at the side edges. The open middle cavity 20 has four cavity projection guides 25. Two projection guides extend downward from top wall 21 of the open middle cavity 20, and two projection guides 25 extending upward from the bottom wall 22 of the open middle cavity 20. The two end side surface 17 also has an extended outer edge joining lip 85 extending around the outside circumference at each longitudinal side end 17. The inside surface walls 15 of the side bar 2 segment can have a varying number of elliptical cross brace entry/hanger wire ports 16, depending on the length of the side bar segment 2, and may be utilized if bowing is observed on excessively large stretcher bar frames 1.

FIGS. 9, 10, 11, 12, and 13 are detail drawing of the fixed corner segment from different views. The corner segment 4, has an upper front side surface 75, a back side surface 76, an outside side wall 13, an inside side wall 15, and two side end surfaces 17. The corner segment 4 also has an angular front side surface 74 between the upper front side surface 75 and the extended outside front canvas corner 73, a back side surface 76, with a trapezoid fastening channel 77, along the center longitudinal axis, having a fastening channel bottom wall 78, and two fastening channel side walls 79, allowing for the insertion of a permanent or removable seal-healing fastening block 80. The outside side wall 13 has an open outside aperture 12 near each side end 17, along the center longitudinal axis end, and an aperture engagement surface 27, adjacent to the aperture opening of each open outside apertures 12. The inside side wall 15 has an open inside aperture 14, near each side end 17, along the center longitudinal axis end, and an aperture engagement surface 27, adjacent to the aperture opening of each open inside apertures 14, and at least one cross brace entry/hanger wire port 16. The end side 17 of each corner segment 4 has an open rectangular upper cavity 18, an open rectangular lower cavity 19, and an open rectangular middle cavity 20. The open middle cavity 20 encompasses the area between an internal top cavity wall 21, the opposing bottom cavity wall 22, and the pair of side cavity walls 23, each of which connects the top wall to the bottom wall at the side edges. The open middle cavity 20 has four cavity projection guides 25. Two projection guides extend downward from top wall 21 of the open middle cavity 20, and two projection guides 25 extend upward from the bottom wall 22 of the open middle cavity 20. The two side end surfaces 17, also has an extended outer edge joining lip 85, extending around the outer circumference at each side end 17. The inside surface walls 15 of the corner segments 4 have a varying number of elliptical cross brace entry/hanger wire ports 16, which may be utilized if bowing is observed on excessively large stretcher bar frames. The corner segment 4 are pre-molded, and of a fixed outside length, allowing for exact 90 degree square corners, without the need for wedges, fixed or adjustable corner bracing, or stabilizing tension braces within the stretcher bar frame 1.

FIGS. 14, 15, 16, and 17 are detail drawing of the connecting segment from different views. The connecting segment 8 has a central base 32, two opposite width and height side surfaces 96, an upper middle edge surface 50, two internal side edge surfaces 51, two upper outer top edge surfaces 52, two outside side surfaces 53, and a bottom edge surface 54. The central base 32 has two upper rectangular guides 65, with an rectangular open center 89, extending distally on each upper side surface 96 of the central base 32, two lower rectangular guides 69, with an rectangular open center 89, extending distally on each lower side 96 of the central base 32, and a pair of opposing flexible flat head latching arms 34, extending distally on each middle horizontal axis side surface 96 of the central base 32, and a circular aperture guide bar opening 33, in the horizontal axis center of the central base 32.

The connecting segment 8, also has a circular aperture guide bar opening 33, on the connecting segment base side surface 96, providing an opening space for an optional internal stabilizing bar, if necessary, to be inserted between side bar 2 and corner 4 segments. The optional guide bar 24 fits and is secure between the side bar 2 and corner 4 segment's four cavity projection guides 25, within the middle open cavity 20. A guide bar 24 can be inserted to provide an additional structural mean to guide, align, stabilize, and prevent twisting between a corner segment 4 to a second corner segment 4, a corner segment through side bar 2, or side bars 2, to a second corner segment 4, or between side bars 2.

The center horizontal axis on each connecting segment 8 base side surfaces 96, has a pair of opposing outward facing flexible flat head latching arms 34 on opposite sides. Each flexible flat head latching arm 34, a flexible arm member stems 35, a flat tooth surface 42, sloping surface around the circumference of the flat tooth 43, a flat tooth latching surface 26, and a flat tooth interior hollow back surface 46.

The stretcher bar frame 1, features a quick side release, interlocking, mechanism to connect and interlock side bar 2, corner 4, and connecting 8 segments. FIG. 2 illustrates the mechanism to align plugs 10 and sockets 11 to connect and interlock adjacent stretcher bar frame 1 side bar 2 to side bar 2 segments, side bar 2 to corner 4 segments, and corner 4 to corner 4 segments together. The interlocking mechanism utilizes a dual pair of opposing outward facing flexible flat head latching arms 34 (referred to as plugs), that extending distally and in opposite directions from the connecting segment base 32 and is adapted to be inserted into and align with the socket 11 of each adjacent side bar 2 and corner 4 segment within the middle open cavity 20. Each connecting segment's 8 flexible flat head latching arm 34, has a flat tooth latching surface 26, adjacent to the flat tooth surface 42, and a sloping surface 43, around and between the flat tooth latching surface 26, and the flat tooth surface 42, allowing for easy insertion of the flexible flat head latching arms 34, into the middle open cavity 20. As the connecting segment 8 plug 10 is fully inserted into a side bar 2 or corner segment 4 socket 11, in the open middle cavity 20, of each side bar 2 and corner 4 segment, the latching surface 26 of each flat tooth surface 42, on each flexible flat head latching arm 34 flexes inward towards the center longitudinal axis center of the socket's 11 open middle cavity 20. Once fully inserted, each flexible flat head latching arm 34 aligns and latches simultaneously flexes back outwardly to its original relaxed position.

The plug 10 and socket 11 members are mated and locked by means of an aperture engagement surface 27, and a flat tooth latching surface 26, forming an interlocking connecting surface. The latching surface encompasses both a aperture engagement surface 27, positioned around the inside of the outside aperture 12 and positioned around the inside of the inside aperture 14, and a mating latching surface 26 positioned on each flexible flat headed latching arm 34 adjacent to the flat tooth surface 42. The aperture engagement surface 27 is positioned to match with a flat tooth latching surface 26. Upon mating, the flat tooth surfaces 42, extends through the open outside aperture 12, of the centered outside side wall 13, and the open inside aperture 14, of the centered inside side wall 15, to connect and interlock the plug 10 and socket 11 together. This process continues until the desired stretcher bar configuration is fully assembled.

A quick side-release mechanism is formed at each side wall aperture 12 and 14 openings within the socket 11 open middle cavity 20, through a portion of the outside side wall 13 aperture 12, and inside side wall 15 aperture 14, of each side bar 2 and corner 4 segment, once the connecting segment plug 10 is fully inserted into the socket 11. Apertures 12 and 14 also allow for easy access to each flat tooth surface 42, of each flexible flat headed latching arm 34, from the exterior outside side wall 13 and inside side wall 15 at each end side 17 of the socket 11, in order to pivot the flexible flat headed latching arms 34, inward towards the center longitudinal axis center of the socket's 11 open middle cavity 20, to free the connection between the connecting segment's 4 flat tooth latching surfaces 26 surfaces and the side bar 2 and corner 4 segments aperture engagement shoulder 27 surfaces, allowing for the release and separation adjoining stretcher bar frame 1 side bar, corner 4, and connecting 8 segments.

Each flat tooth latching surface 26 fits into a corresponding aperture engagement surface 27, to evenly match the outside side wall 13 and inside side wall 15 surfaces of the side bar 2 and corner 4 segments, preventing canvas 9 indentations at the flat tooth surface 42 of the outside side wall 13, of the stretcher bar frame 1.

Figure 4:
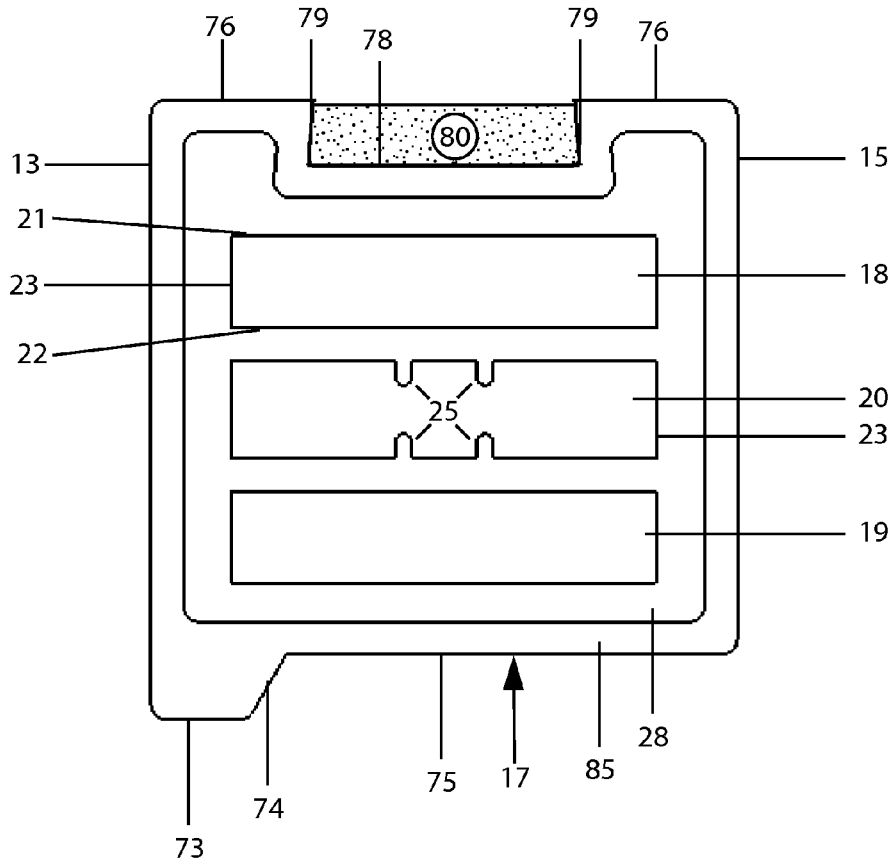
FIG. 4 is a cross-section of a stretcher bar frame side bar and corner segment similar to that of FIG. 2, except the frame sections have been rotated about its width-wise axis 90 degrees to illustrate the open side end thereof; illustrating the upper, middle and lower open cavities, upward and downward projecting guides, extended outer edge joining lip, the self-healing fastening block, and the fastening channel.
Figure 5:
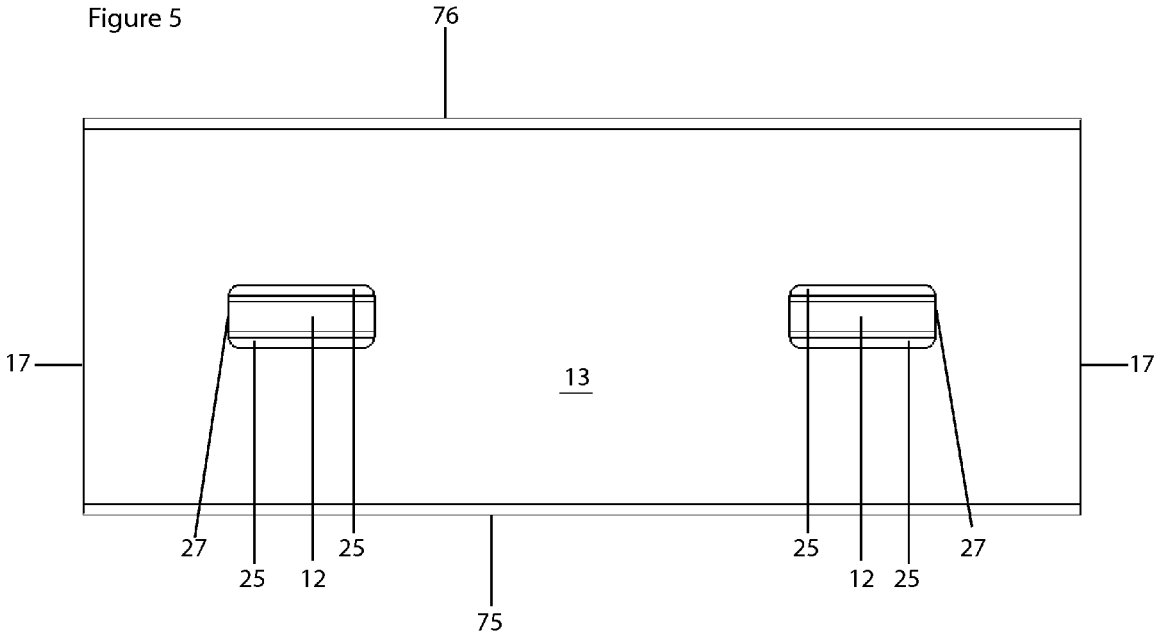
FIG. 5 is similar to that of FIG. 3 except the side bar frame section has been rotated about its length-wise axis 90 degrees to illustrate the outside release aperture.
Figure 6:
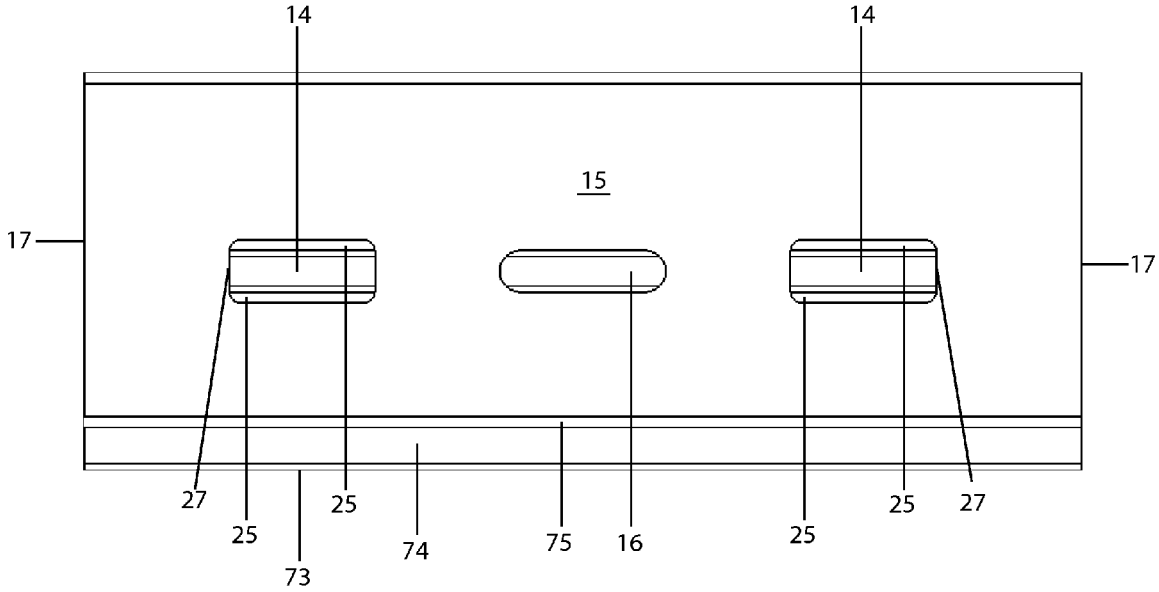
FIG. 6 is similar to that of FIG. 3 except the side bar frame section has been rotated about its length-wise axis 90 degrees to illustrate the inside release aperture, cross-brace entry/hanger wire port.
Figure 7:
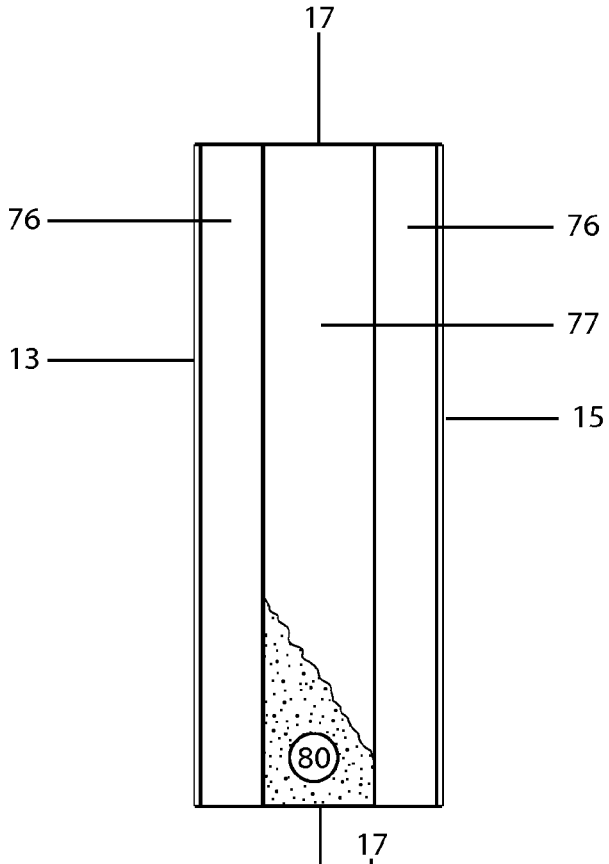
FIG. 7 is similar to that of FIG. 3 except the side bar frame section has been rotated about its width-wise axis 90 degrees to illustrate the back view of the back side, fastening channel, and a portion of the fastening block.
Figure 8:
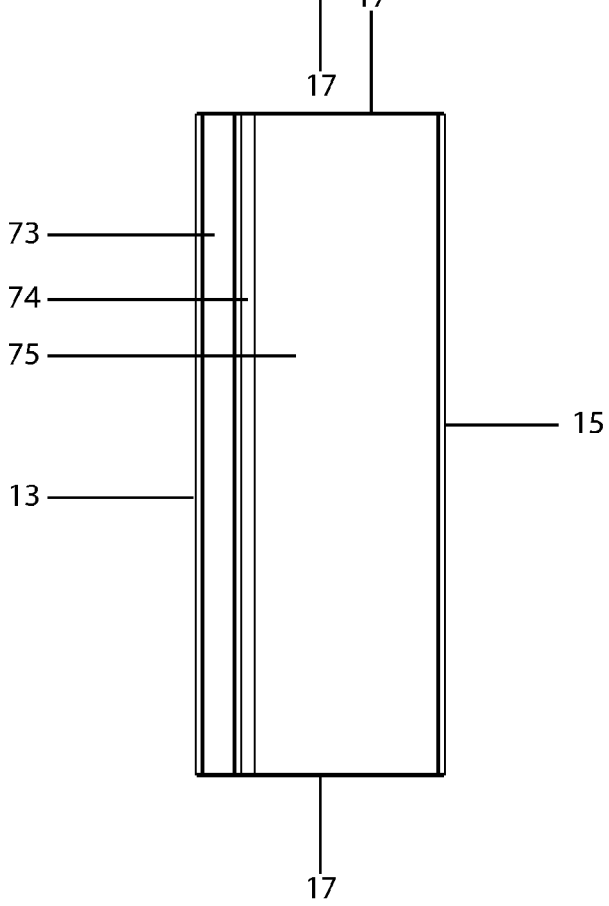
FIG. 8 is similar to that of FIG. 3 except the side bar frame section has been rotated about its width-wise axis 90 degrees to illustrate the top view of the extended outside front canvas corner, angular front-side surface, and front side surface.
Figure 9:
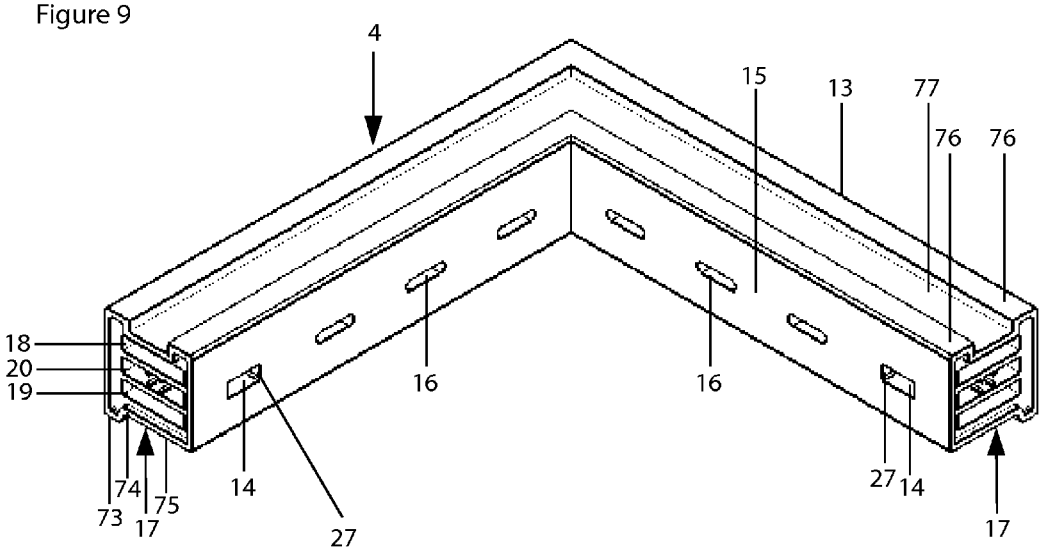
FIG. 9 is a partial three-dimensional longitudinal section view of a corner segment and interlocked female socket member in FIG. 2, illustrating the locking mechanism means between adjacent frame segments of FIG. 1, illustrating the two inside release apertures, cross-brace entry/hanger wire ports.
Figure 10:
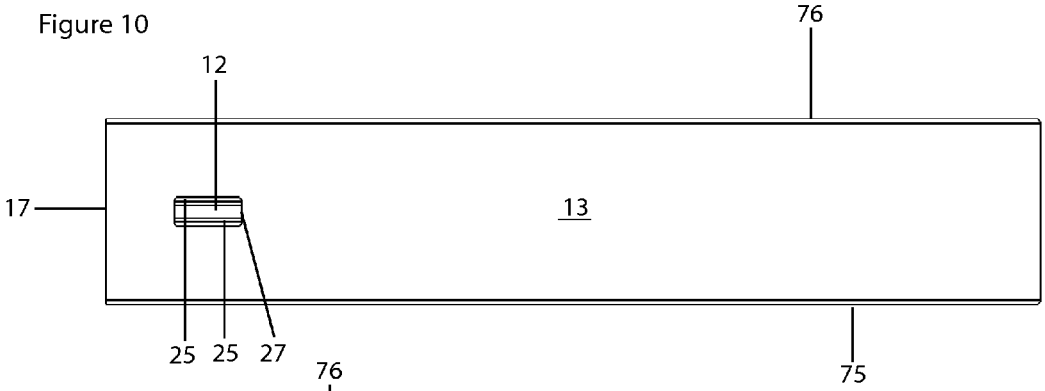
FIG. 10 is similar to that of FIG. 9 except the corner frame segment has been rotated about its length-wise axis 90 degrees to illustrate the left outside release aperture.
Figure 11:
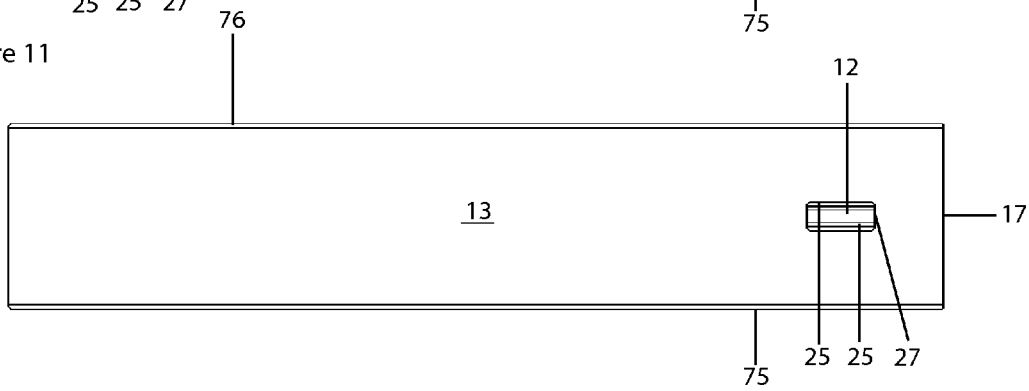
FIG. 11 is similar to that of FIG. 9 except the corner frame segment has been rotated about its length-wise axis 180 degrees to illustrate the right outside release aperture.
Figure 12:
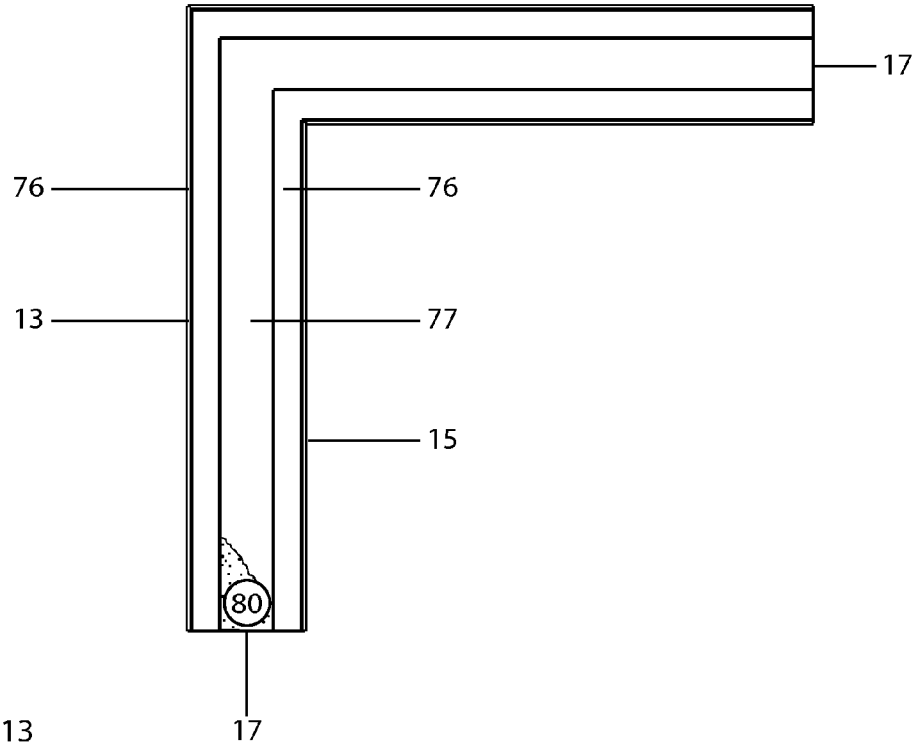
FIG. 12 is similar to that of FIG. 9 except the corner frame segment has been rotated about its width-wise axis 90 degrees to illustrate the back view of the back side, fastening channel, and a portion of the fastening block.
Figure 13:
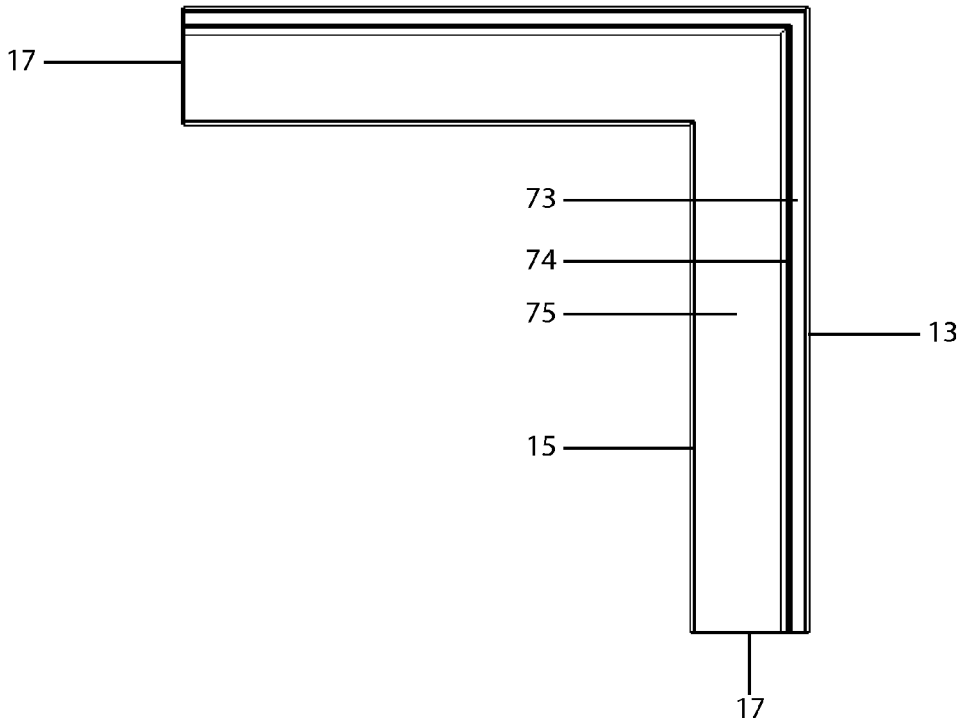
FIG. 13 is similar to that of FIG. 9 except the corner bar frame segment has been rotated about its width-wise axis 90 degrees to illustrate the top view of the extended outside front canvas corner, angular front-side surface, and front side surface.

In FIGS. 4 and 9, of this embodiment, the cross-sectional end side 17 view of each side bar 2 and corner 4 segment depicts an extended outside front canvas corner 73, an angular front-side surface 74, and a front side surface wall 75. The extended outside canvas corner surface 73, is integrated into each stretcher bar frame 1 side bar 2 and corner 4 segment to provide a supporting rim edge around the stretcher bar frame 1 perimeter, to support canvases or other material above the majority of the front side surface wall 75. The adjacent extended outside front canvas corner 73 has an angular front-side surface 74 that slopes downward from the extended outside front canvas corner 73, to the larger front side surface 75, and is designed to allow the main body of the stretcher bar frame surface to remain flat and without indentation after a canvas has been fastened. The extended outside front canvas corner 73, around the stretcher bar frame 1 perimeter, also serves to reduce adherence of paint or oil leaching through a canvas on to the stretcher bar frame 1, thus allowing a canvas to be easily removed.

In FIGS. 4 and 9, of this embodiment, each side bar 2 and corner 4 segment has projecting guides 25 extending downward from top cavity wall 21 of the middle open cavity 20, and upward from the bottom wall 22 of the middle open cavity 20. The top pair and bottom pair of projecting guides 25, extend from the open side end 17 of the socket 11 inward towards the adjacent open side end 17, on each side bar 2 and corner segments 4. The top pair and bottom pair of projecting guides 25 are intended to mate with an internal guide bar 24, and is utilized to further stabilize longer side length and width, if an internal supporting brace if necessary. The particular size, shape, and location of the projecting guides 25 and guide bar 24 can deviate as long as the guiding mechanism functions fundamentally as described herein.

Figure 14:
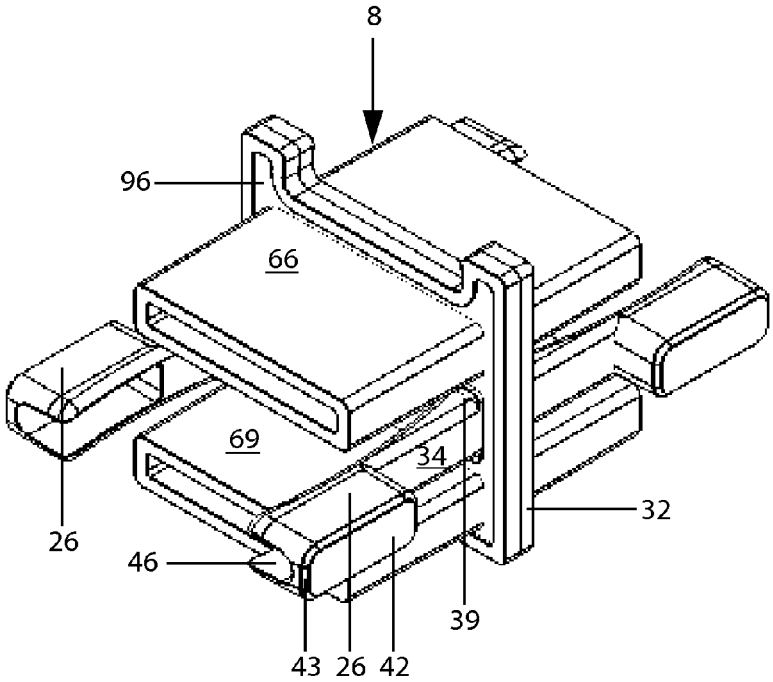
FIG. 14 is a partial three-dimensional longitudinal section view of a connecting segment interlocking male socket member in FIG. 2, illustrating the locking mechanism means between adjacent side bar and corner frame segments of FIG. 2, illustrating the connecting segment base, flexible flat headed latching arms, flat tooth surface, flat tooth latching surface, flexible arm member stems, and upper and lower rectangular guides.
Figure 15:
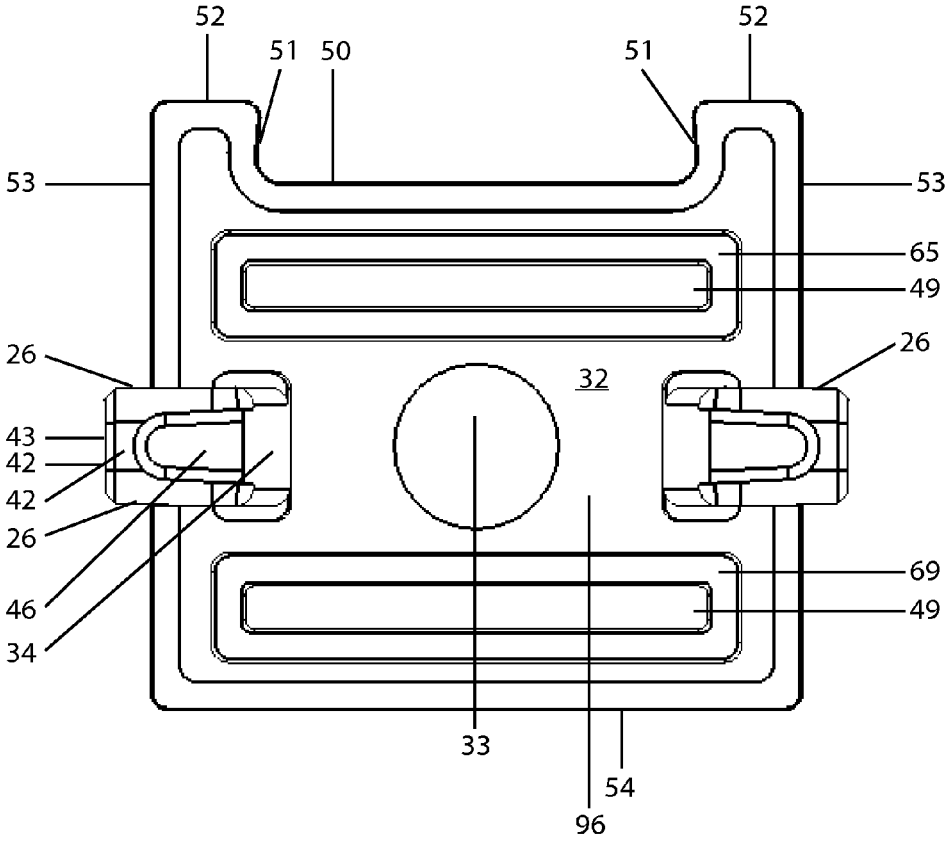
FIG. 15 is similar to that of FIG. 14 except the connecting frame segment has been rotated about its length-wise axis 90 degrees to illustrate the connecting segment base, flexible flat headed latching arms, flat tooth surface, flat tooth latching surface, flexible arm member stems, upper and lower rectangular guides, and circular guide bar opening.
Figure 16:
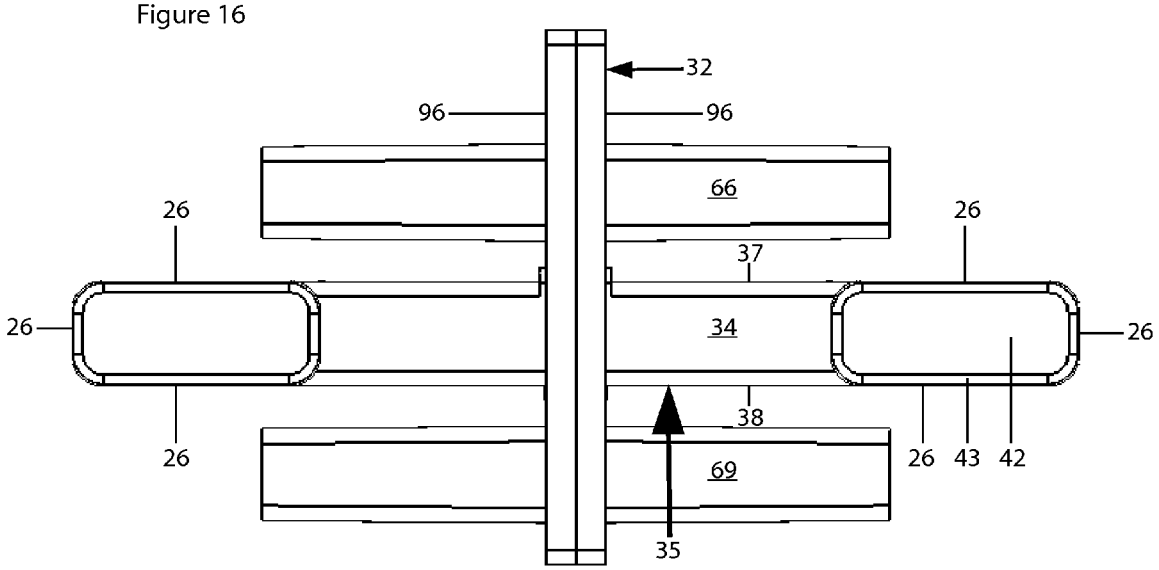
FIG. 16 is similar to that of FIG. 14 except the corner frame segment has been rotated about its length-wise axis 90 degrees to illustrate the connecting segment base, flexible flat headed latching arms, flat tooth surface, flat tooth latching surface, opposite base side surfaces, and upper and lower rectangular guides.
Figure 17:
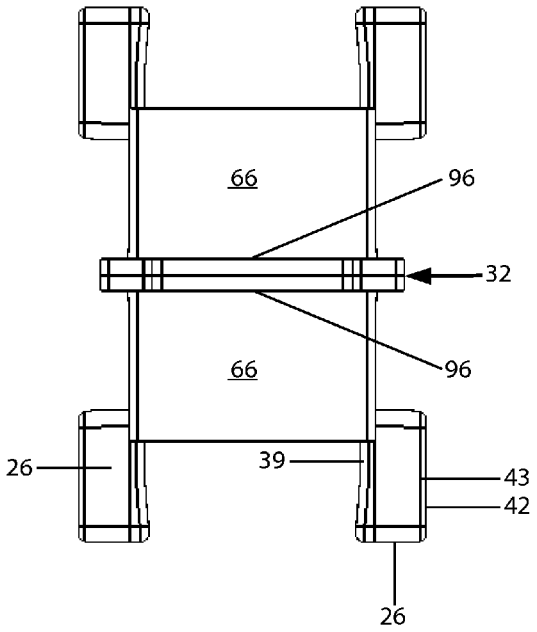
FIG. 17 is similar to that of FIG. 14 except the corner frame segment has been rotated about its width-wise axis 90 degrees to illustrate the top view of the base, the flexible flat headed latching arms, flat tooth surface, flat tooth latching surface, opposite base side surfaces, and upper rectangular guide bar.

In FIGS. 4 and 9 of this embodiment, the interior side ends 17 of each side bar 2 and corner 4 segment has an upper 18 and lower 19 rectangular guide bar opening, that mates with the connecting segment's 8 upper 65 and lower 69 rectangular guide bars in FIG. 14, for even alignment and added strength. The connecting 8 segment's upper 65 and lower 69 rectangular guides, extends distally from the connecting segment's base side surface 96, into a corresponding upper 18 and lower 19 rectangular guide bar opening, along the upper and lower longitudinal axis to direct and support the connecting side bar 2, corner 4, and connecting segments 8.

Each side bar 2 and corner 4 segment has an extended outer edge joining lip 85 along the entire outer circumference creating a recess slot 28, on the open socket 11 end sides 17. The extended outer edge joining lip 85 enables the connecting segment base 32 to be inserted within side bar 2 and corner segments 4, to further align the side bar 2 and corner 4 segments for a tight and straight fit. The particular size, shape, and location of the recess slot 28 and projecting lip 85 can deviate as long as the guiding mechanism functions fundamentally as described herein.

The stretcher bar frame 1 can be quickly expanded, reconfigured, disassembled, or stored. To expand, reconfigure, or disassemble the plug 10 from the socket 11, each plug's 10 pair of flat tooth latching surfaces 26 are concurrently pressed inward forcing each flexible flat headed latching arm 34 inward until the plug 10 flat headed latching surfaces 24 disengage and clears the socket 11 the pair of aperture engagement surfaces 27, allowing the connecting side bar 2, corner 4 and connecting 8 segments to be released, pulled apart, and separated from other adjoining stretcher bar frame 1 segments. This process is continued until the stretcher bar frame 1 is completely disassembled or until the user assembles another square or rectangular shape to form another stretcher bar frame 1.

Figure 3:
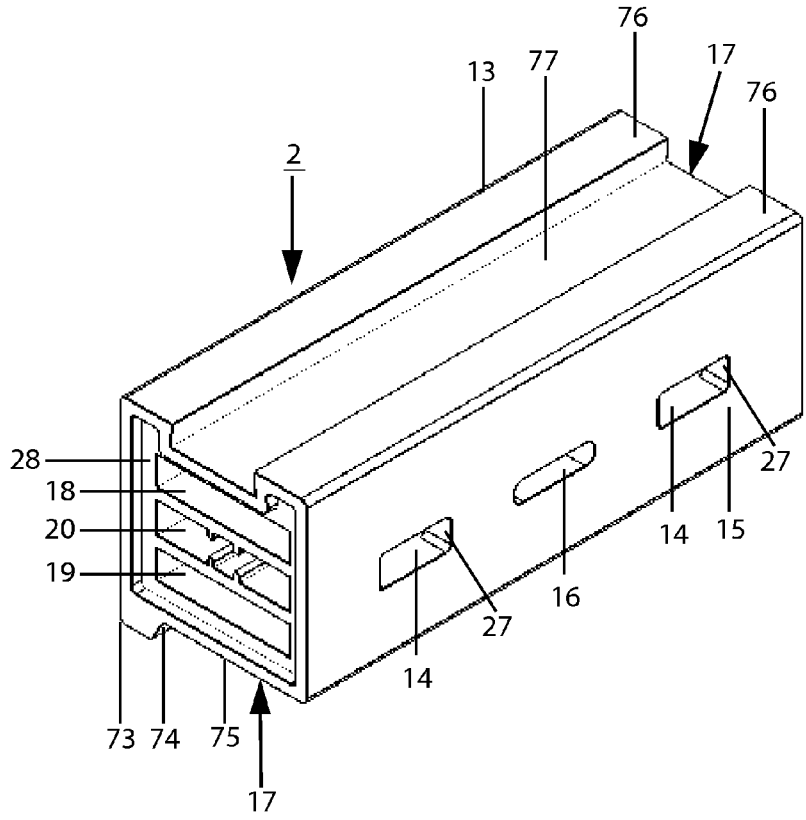
FIG. 3 is a partial three-dimensional longitudinal section view of a side bar segment in FIG. 2, illustrating the female socket member locking mechanism means between adjacent frame segments of FIG. 1.

FIGS. 2, 3, and 9, illustrates the stretcher bar frame's 1 back side surface 76 canvas fastening system in FIG. 1, illustrating a back side isosceles trapezoid shape self healing fastening block 80 and block channel 77, along the center longitudinal axis. The back side center surface 76 of each side bar 2 and corner segment 4 has a fastening block channel 77, consisting of a channel bottom wall surface 78, channel side wall surfaces 79, which holds a self-healing fastening block 80, which allows a means to insert staples, tacks, or other gripping fasteners 84, around the perimeter, through a canvas 9, and into the self healing fastening block 80, to secure a canvas 9.

To provide an easy means to fasten and secure single or multiple layers of canvas 9, to the stretcher bar frame 1, a self-healing fastening block 80 consisting of flexible polyurethane, a resilient polyolefin, or a similar functional type material (such as wood or cardboard) with self-healing compressive strength allowing staples, tacks, or other gripping fasteners 84 to secure the canvas 9 to the stretcher bar frame 1. Other similar or suitable materials maybe used or substituted for the fastening block 80; include materials such as soft-wood, cardboard, rubber, silicone, or a cork-like material. The staples, tacks, or other gripping fasteners 84 are capable of being inserted through single or multiple layers of canvas 9. The penetration of the staples, tacks, or other gripping fasteners 84, allows for secure mounting of a canvas 9 to the self-healing fastening block 80, on the back side of the stretcher side bar 2 and corner 4 segments. The durable self-healing fastening block 80, allows the canvas 9 to be mounted/re-mounted stretched/re-stretched, repeatedly without damage to the stretcher bar frame 1 or canvas 9.

FIGS. 3, 4, and 9 depicts the cross-brace entry/hanger wire ports 16, that are incorporated into and along the inside side wall 15 of each side bar 2 and corner 4 segments. The cross-brace entry/hanger wire ports 16 are available for added tension and stability, if a cross-brace if necessary for bowing.

The same cross-brace entry/hanger wire ports 16 also allows for insertion and connection of hanger wires into the stretcher bar frame 1, allowing for an artist's canvas or painting to be hung for gallery displays or exhibitions.

The depth is not limited to museum profiles and includes traditional and gallery depths as well.

The specifications and drawings of this invention may be embodied and practiced in other specific forms and modification without departing from the spirit and essential characteristics thereof. The present embodiments therefore are considered in all respects as illustrative and not restrictive. The scope of the invention is indicated by the appended claims rather than by the foregoing description. All variations, substitutions, departures, and changes that come within the meaning and range of equivalency of the claims therefore are intended to be embraced therein.

What is claimed is:

1. A stretcher bar frame and fastening system for mounting, re-stretching, remounting, and removing artist canvas comprising:

a plurality of snap fitting, interlocking, interchangeable, variable lengths side bar segments, fixed length right angle corner segments, and connecting segments, featuring a locking mechanism utilizing a male plug member and a female socket member, that interconnects to form an array of various size square or rectangular frames;

a female socket member side bar segment end surface, having an open middle cavity at a center width-wise axis thereof, having in connecting internal top wall, a bottom wall, and a pair of opposing side walls, which is open at both longitudinal end surfaces;

a female socket member corner segment end surface, having an open middle cavity at a center width-wise axis thereof, having a connecting internal top wall, a bottom wall, and a pair of opposing side walls, which is open at both perpendicular longitudinal end surfaces;

a male plug member, connecting segment end, having two pair of opposing flexible flat head latching arm members extending in opposite directions from the central horizontal axis of the connecting segment base side surfaces, for insertion through the open end of said middle cavity of said female socket member, each said flexible arm member running distal and parallel along opposite sides of the plug member base, wherein each said flexible arm member having a pivotal flexible arm member stem, a flat tooth outer side surface, a flat tooth latching surface, an arm member top surface, an arm member bottom surface, a sloping surface adjacent to the flat tooth perimeter, a proximate flat tooth latching surface, and an arm member back side surface;

a female socket member having aperture engagement surfaces extending and directing from the inner to an outer surface near each side swills of said socket member, each engagement shoulder being disposed on a midway line between said top wall and said bottom wail of said cavity, each aperture engagement surface being adapted to mate with a corresponding flat tooth latching surface on each said flexible flat headed latching arm member, when each said flexible flat headed latching arm member is fully inserted into the open end of said middle cavity, to engage and interlock the said plug member to said socket member;

a aperture engagement surface adjacent to said flat tooth outside side latching surface on each said flexible flat headed latching arm, said latching, surface and said aperture engagement surface defines an engaging interlocking coupling surface, said engaging interlocking coupling surface being positioned to latch to a corresponding position in the socket member open middle cavity;

a means for disengaging said flat tooth latching surface on said flexible flat headed latching arm member of said plug, member, from said aperture engagement surface of said socket member, to permit decoupling of said plug member from said socket member;

an insertable internal guide bar running distal and parallel between two said flexible flat headed arm members on said plug member, between the mating guide bar projections extending downward from the top cavity wall surface and upward from the bottom cavity wall surface of said open middle cavity of said socket member, running through a circular opening in the connecting segment base, running parallel from said open side corner segment cavity to said opposing open side corner segment cavity, and through an inserted adjacent in-line side bar segments:

a joining lip around the outer perimeter edge of said socket member end surface that mates with a connecting segment plug base to further align and secure said adjacent plug member between said side bar segments, corner segments, or between a side bar and a corner segment;

a fastening channel with a self-healing block on the back side surface of each side bar and corner segment to attach and secure canvas to said stretcher bar frame with staples, tacks, or other gripping fasteners; and a stretcher bar front side outer surface, on all side bar and corner segments, having an extended outside front corner, over which a canvas is stretched, adjacent to an angular front-side surface, that sloping downward towards the front side surface.

2. The stretcher bar frame according to claim 1 wherein each side bar and corner segment has a female socket member positioned at opposite end surfaces.

3. The stretcher bar frame according to claim 1 wherein each connecting segment has a pair of opposing outward facing male plug members positioned away from the connecting segment base in opposite directions.

4. The stretcher bar frame according to claim 1 wherein the side length and width can be increased or decreased by adding or removing variable length side bar segments to form an array of various sizes square or rectangular frames.

5. The stretcher bar frame according to claim 1 wherein the outside surface wall and inside side wall surface each having a predetermined thickness forming a rectangular aperture engagement surface, wherein each said aperture engagement surface corresponds to each said flat tooth latching surface on said flexible flat headed latching arm member, through a longitudinal axis situated between inner side and outer side surfaces.

6. The stretcher bar frame according to claim 1 wherein each said flexible flat head latching arm having a flat tooth latching surface, said latching surface being adapted to mate with and affix against said proximal aperture engagement surface forming an engaging locking coupling surface, when said plug member is coupled to said socket member.

7. The stretcher bar frame according to claim 1 wherein the means for disengaging each flexible flat headed latching arm through said side walls of said socket member, whereby each said flat tooth surface is exposed through each said aperture when said plug member is coupled to said socket member.

8. The stretcher bar frame according to claim 1 wherein said means for disengaging comprises of flexible arm member stems which are coupled between said plug member flat tooth latching surfaces and said aperture engagement surfaces, and which are adapted to be pivoted away from said side walls of said socket member inwardly towards said open middle cavity to release and free said flat tooth latching surfaces from said aperture engagement shoulders to permit decoupling of said plug member from said socket member.

9. The stretcher bar according to claim 1 wherein said means for quickly decoupling and disassembling stretcher bar frame segments to a transportable size for storing or shipping.

10. The fastening system according to claim 1 wherein a fastening channel secures a fastening block comprising of a self-healing material or a functionally equivalent material to secure single or multiple layers of canvas around the perimeter of the stretcher bar by inserting said staples, tacks or other gripping fasteners.

11. The fastening system according to claim 1 wherein a plurality of said fastening channels with self-healing fastening blocks are configured on said exposed back side surface thereof, to secure single or multiple layers of canvas in two mutually perpendicular directions in a flat plane on said front side surface of said stretcher bar frame.

12. The fastening system according to claim 1 wherein a plurality of fastening channels with self-healing fastening blocks are configured on said exposed back side surface thereof, to provide access to said staples, tacks, or other gripping fasteners for purposes to mounting, remounting, re-stretching, or dismounting single or multiple layers of canvas along four variable length edges.

13. The fastening system according to claim 1 wherein a plurality of fastening channels with self-healing fastening blocks are configured on said exposed back side surface thereof, to provide a surface for a plurality staples, tacks, or other gripping fasteners to be uniformly arranged, spaced, in line, and in pairs, along in each of the four self heating fastening block edges that run substantially parallel to each along the corresponding length-wide edges and width edges.

14. The fastening system according to claim 1 wherein a plurality of said fastening channels with self-healing fastening blocks are configured on said exposed back side surface thereof, to provide access to said staples, tacks, or other gripping fasteners for purposes of adjusting and sustaining stretching tension of said canvas in two mutually perpendicular directions.

15. The fastening system according to claim 1 wherein a plurality of said fastening channels with said self-healing fastening blocks are configured on said exposed back side surface thereof, to provide access to said staples, tacks, or other gripping fasteners for purposes of adjusting and correcting shifting and non- uniform distribution of tensional stress in a canvas.

16. The fastening system according to claim 1 wherein, said fastening block provides a method of securing canvas, including in particular art canvas, onto said self-healing block using said staples, tacks, or other gripping fasteners, enabling easy removal of said canvas for storage and shipping.

* * * * *